US008914933B1

(12) United States Patent
Petty et al.

(10) Patent No.: US 8,914,933 B1
(45) Date of Patent: Dec. 23, 2014

(54) BROOM ASSEMBLY FOR SWEEPING MACHINE AND METHOD OF OPERATION

(75) Inventors: Chris Petty, Calhoun, GA (US); Brent Michaels, Flat Rock, AL (US)

(73) Assignee: Roadtec, Inc., Chattanooga, TN (US)

( * ) Notice: Subject to any disclaimer, the term of this patent is extended or adjusted under 35 U.S.C. 154(b) by 353 days.

(21) Appl. No.: 13/415,950

(22) Filed: Mar. 9, 2012

Related U.S. Application Data

(60) Provisional application No. 61/465,399, filed on Mar. 18, 2011.

(51) Int. Cl.
*E01H 1/05* (2006.01)

(52) U.S. Cl.
USPC ..... 15/82; 15/78

(58) Field of Classification Search
USPC ..... 15/52.1, 78, 82; 299/36.1; 404/83
See application file for complete search history.

(56) References Cited

U.S. PATENT DOCUMENTS

| | | | | |
|---|---|---|---|---|
| 2,548,676 | A | 4/1951 | Milz et al. | |
| 2,711,551 | A | 6/1955 | Wagner et al. | |
| 3,071,793 | A | 1/1963 | Le Grand | |
| 3,649,985 | A | 3/1972 | Hunt | |
| 4,678,365 | A | 7/1987 | Ban et al. | |
| 5,560,065 | A * | 10/1996 | Young | 15/82 |
| 6,622,336 | B2 * | 9/2003 | Jackson | 15/82 |
| 6,672,675 | B1 * | 1/2004 | Swain | 299/36.1 |
| 6,981,820 | B2 | 1/2006 | Nelson | |
| RE38,973 | E | 2/2006 | Smith | |
| 7,651,295 | B2 | 1/2010 | Eppes et al. | |
| 7,793,376 | B2 | 9/2010 | Rush, Sr. et al. | |
| 2011/0209886 | A1 | 9/2011 | Gendelman et al. | |

* cited by examiner

*Primary Examiner* — Randall Chin
(74) *Attorney, Agent, or Firm* — Chambliss, Bahner & Stophel, P.C.

(57) ABSTRACT

A broom assembly for attachment to a vehicle is adapted to rotate a brush having a tubular core. The broom assembly includes a center section, a left side plate, a right side plate, an idle hub on one of the side plates and a drive hub on the other of the side plates. These hubs define a core axis about which the brush is rotated. A first linear actuator is adapted to move the left side plate along an axis that is parallel to the core axis between a left open position and a left closed position, and a second linear actuator is adapted to move the right side plate along an axis that is parallel to the core axis between a right open position and a right closed position. The broom assembly may be operated in a work mode and a maintenance mode.

13 Claims, 6 Drawing Sheets

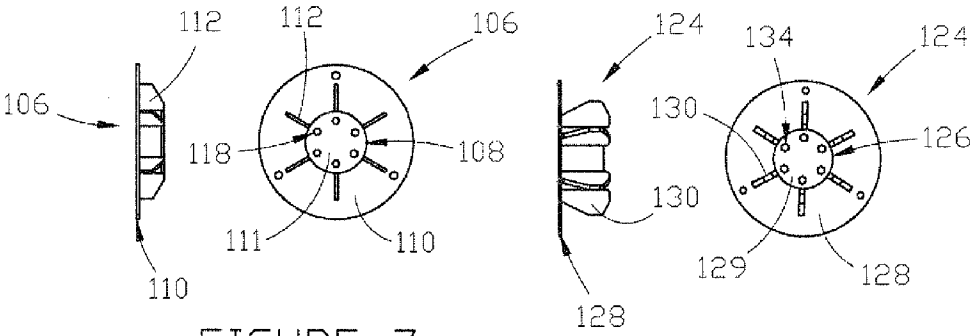
FIGURE 8
FIGURE 7
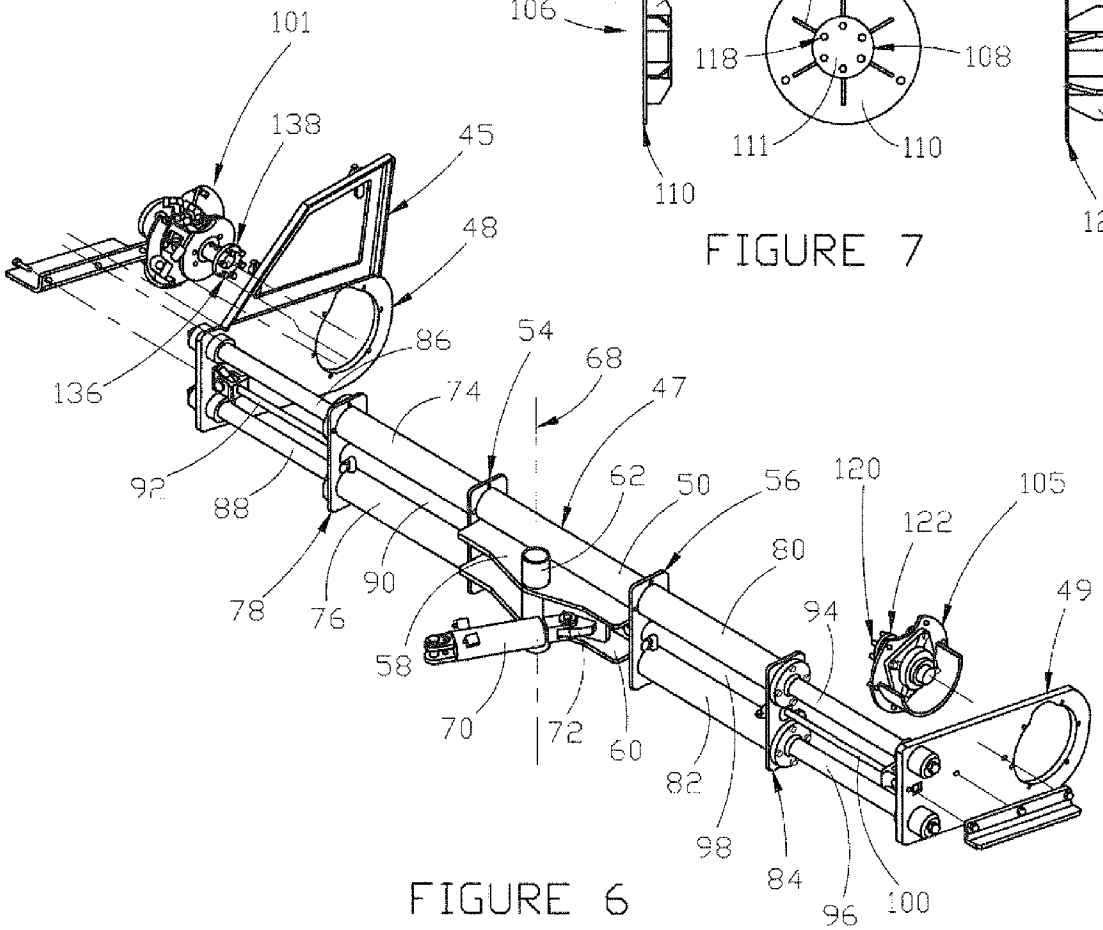
FIGURE 6

BROOM ASSEMBLY FOR SWEEPING MACHINE AND METHOD OF OPERATION

CROSS-REFERENCE TO RELATED APPLICATION

This application claims the benefit of U.S. Provisional Patent Application No. 61/465,399, which was filed on Mar. 18, 2011.

FIELD OF THE INVENTION

The invention relates generally to a broom assembly for a sweeping machine that may be used in sweeping streets, parking lots and other large surfaces. More particularly, the invention comprises a broom assembly for a sweeping machine which employs replaceable brushes.

BACKGROUND OF THE INVENTION

Conventional sweeping machines typically employ a broom assembly comprising one or more brushes mounted for rotation about horizontal and/or vertical axes. Some conventional machines include an integral component for collecting material swept by the brush or brushes. Such collecting components may comprise vacuum systems for capturing the material swept by the brushes, or conveyors for transporting such material to a hopper or an adjacent truck. Other conventional machines may operate by pushing the swept material to one side of the machine where it may be collected by a separate collecting device.

Some conventional sweeping machines include broom assemblies which employ permanent brushes, while others employ replaceable brushes. Typically, a replaceable brush comprises a cylindrical brush core of steel or other durable material having a plurality of bristles disposed around its outer periphery. Generally, a replaceable brush is attached to a conventional broom assembly by one or more locking mechanisms that must be unbolted, unpinned or otherwise removed in order to change the replaceable brush.

One type of replaceable brush is described in U.S. Pat. No. 3,649,985 of Hunt. The broom assembly described in this patent includes a drive shaft that extends through a replaceable hollow brush core. On each end of the drive shaft is mounted a fixed metal plate that is sized so that the hollow brush core may be placed thereover. The fixed metal plate has a plurality of holes that are adapted to receive bolts. A rubber disk with a central hole to receive the drive shaft and a plurality of spaced bolt holes is placed over the drive shaft and into abutment with the fixed metal plate, and a moveable metal plate with a plurality of bolt holes is then placed adjacent to the rubber disk. The bolt holes in the fixed plate, rubber disk and moveable plate are aligned, and bolts are inserted into the holes in these components and tightened to cause the two metal plates to squeeze the rubber disk therebetween. This squeezing of the rubber disk causes it to expand radially outwardly to create a binding frictional fit with the inner surface of the brush core.

Another conventional broom assembly that is adapted to receive a replaceable brush is described in U.S. Pat. No. RE38,973 of Smith. The broom assembly described in the Smith patent comprises an L-shaped frame component to which a pivotal arm is attached so that the arm may be pivoted to form a U-shaped component to which a removable brush of a predetermined length may be attached. A cylindrical hub on the "short" arm of the L-shaped frame is a drive hub that is operatively attached to a drive motor. This drive hub is mounted to the arm by a universal joint and includes a slot to engage a drive lug on the inside of a brush core. The cylindrical hub on the pivotal arm is an idler hub that is also mounted to the arm by a universal joint. The broom assembly that is described in the Smith patent is mounted to an associated vehicle by means of a parallelogram support structure.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context. The use of any and all examples or exemplary language (e.g., "such as") herein is intended merely to better illuminate the invention and not to place a limitation on the scope of the invention. Nothing in the specification should be construed as indicating any element as essential to the practice of the invention unless so stated with specificity.

Various terms are specifically defined herein. These terms are to be given their broadest possible construction consistent with such definitions, as follows:

The terms "upper", "top" and similar terms, when used in reference to a relative position or direction on or with respect to a broom assembly for a sweeping machine or a component or portion thereof, refer to a relative position or direction that is farther away from the ground on which the sweeping machine is placed for operation.

The terms "lower", "bottom" and similar terms, when used in reference to a relative position or direction on or with respect to a broom assembly for a sweeping machine or a component or portion thereof, refer to a relative position or direction that is nearer the ground on which the sweeping machine is placed for operation.

The term "front" and similar terms refer to a component or portion of a broom assembly for a sweeping machine that is farthest from the sweeping machine to which the broom assembly is attached, or to a direction or relative position on such a broom assembly that is away from the sweeping machine to which the broom assembly is attached.

The term "rear" and similar terms refer to a component or portion of a broom assembly for a sweeping machine that is nearest the sweeping machine to which the broom assembly is attached, or to a direction or relative position on such a broom assembly that is nearer to the sweeping machine to which the broom assembly is attached.

The term "forward sweeping direction" is the direction towards the front of the broom assembly that is perpendicular to the core axis of the brush.

The term "left", as used herein to describe a direction or relative position of a broom assembly mounted on a sweeping machine or a component of such a broom assembly, refers to a position or orientation towards the left, as viewed by an observer who is observing in the forward sweeping direction.

The term "right", as used herein to describe a direction or relative position of a broom assembly mounted on a sweeping machine or a component of such a broom assembly, refers to a position or orientation towards the right, as viewed by an observer who is observing in the forward sweeping direction.

The term "linear actuator" refers to an electric, hydraulic, electro-hydraulic or mechanical device that generates force which is directed in a straight line. One common example of a "linear actuator" is a hydraulic actuator which includes a cylinder, a piston within the cylinder, and a rod attached to the piston. By increasing the pressure within the cylinder on one side of the piston (over that on the opposite side of the piston), the rod will extend from the cylinder or retract into the cylinder.

The term "rotary actuator" refers to an electric, hydraulic or electro-hydraulic motor or other device that generates force that is directed along an arc or about a center of rotation.

The term "actuator" refers to a linear actuator and/or a rotary actuator.

The term "controller" refers to a computer, a programmable logic controller, a series of switches in combination with relay logic, or any other device or system that may be employed to control or direct the operation of the invention.

SUMMARY OF THE INVENTION

The invention comprises a broom assembly for a sweeping machine. In a preferred embodiment of the invention, the broom assembly is adapted to open and close on the brush core, allowing the broom assembly to open wider than the length of the brush core so that the brush may be easily removed from the broom assembly. This feature also allows the use of brushes of varying lengths. Furthermore, the broom assembly also allows an operator to shift the brush of the broom assembly to the left or the right. Such a feature is useful when sweeping a milled roadway having outside edges that are elevated above the milled surface. By shifting the brush of the broom assembly towards the edge of a milled surface, it is less likely that the machine will suffer wheel or tire damage from contacting the elevated edge.

More particularly, the invention comprises a broom assembly for attachment to a vehicle, which assembly is adapted to rotate a brush having a tubular core. This broom assembly includes a center section and a pair of side plates, including a left side plate and a right side plate. The broom assembly also includes a pair of hubs, including an idle hub on one of the side plates and a drive hub on the other of the side plates. These hubs define a core axis about which the brush is rotated. A first linear actuator is adapted to move the left side plate with respect to the center section along an axis that is parallel to the core axis between a left open position and a left closed position, and a second linear actuator is adapted to move the right side plate with respect to the center section along an axis that is parallel to the core axis between a right open position and a right closed position.

In order to facilitate an understanding of the invention, the preferred embodiment of the invention, as well as the best mode known by the inventors for carrying out the invention, is illustrated in the drawings, and a detailed description thereof follows. It is not intended, however, that the invention be limited to the particular embodiment described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and wherein:

FIG. 6 is a perspective view of a portion of the broom assembly of FIGS. 2-5.

FIG. 7 shows a front and side view of the idle hub of a preferred embodiment of the invention.

FIG. 8 shows a front and side view of the drive hub of a preferred embodiment of the invention.

DESCRIPTION OF THE PREFERRED EMBODIMENTS OF THE INVENTION

Figure 1:
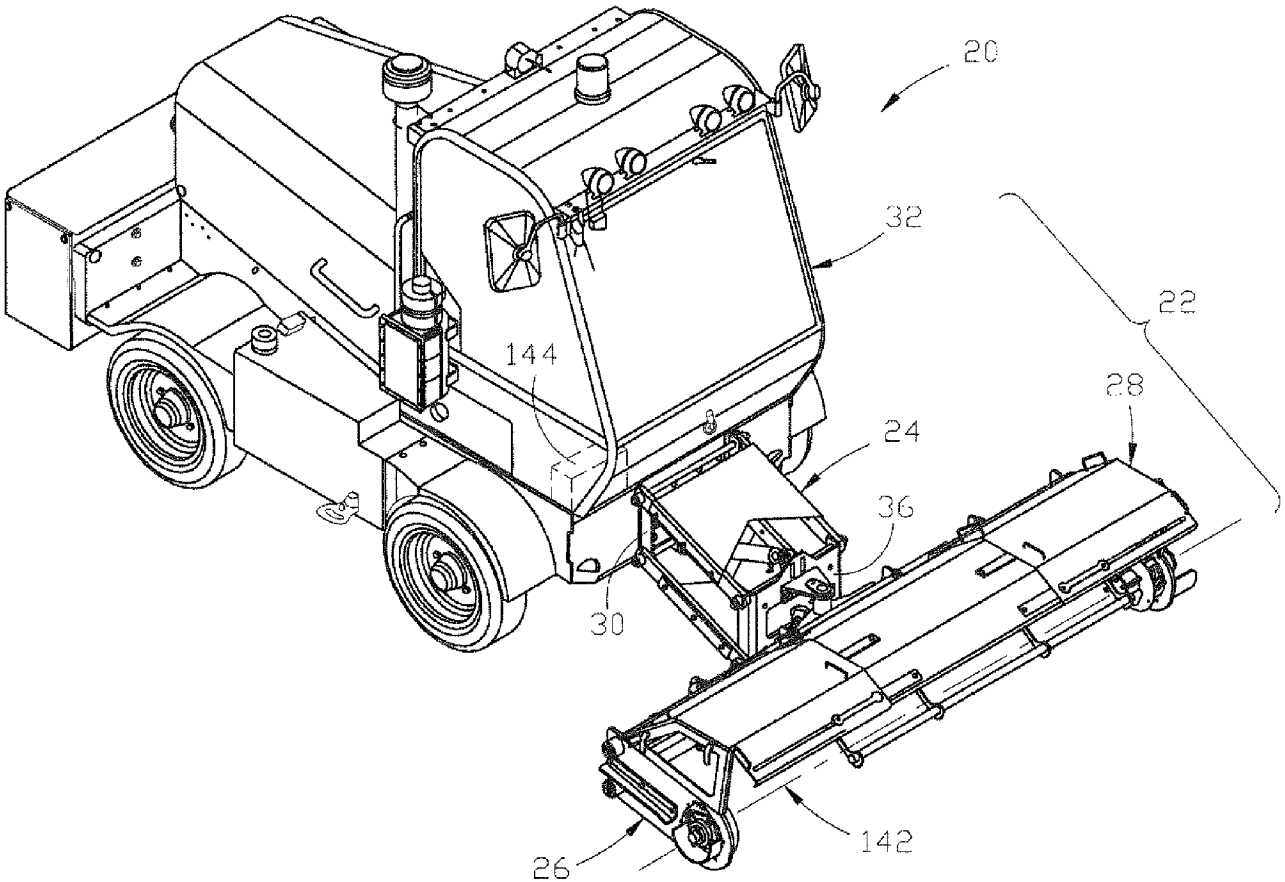
FIG. 1 is perspective view of a sweeping machine that is equipped with a preferred embodiment of the invention.
Figure 4:
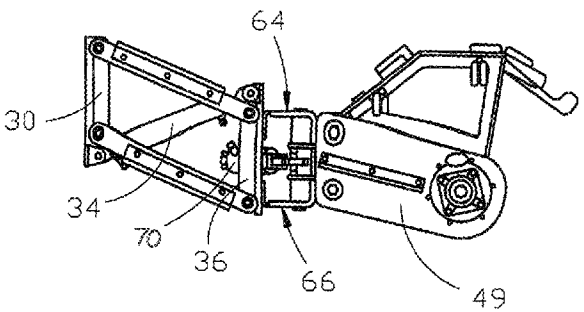
FIG. 4 is a side view of the broom assembly of FIGS. 2 and 3.
Figure 3:
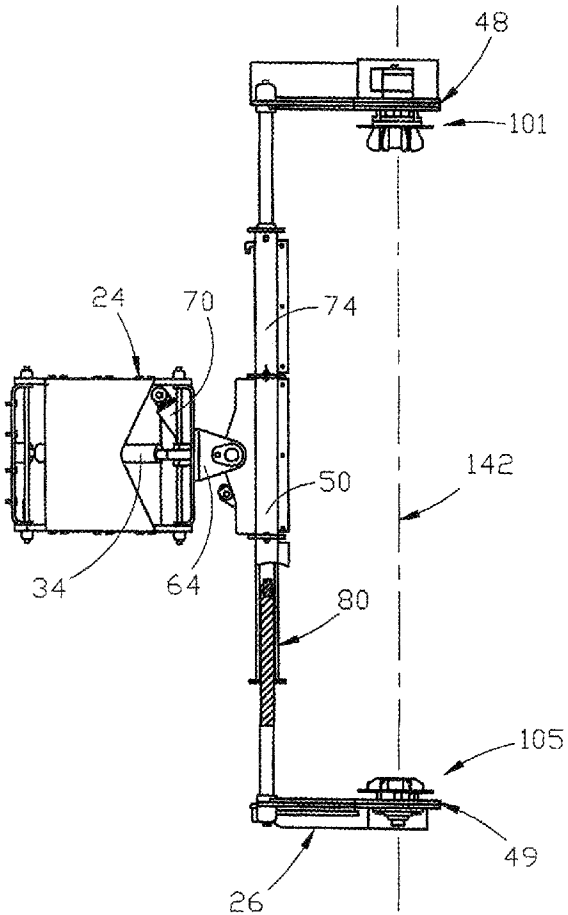
FIG. 3 is a top view of a portion of the broom assembly of FIG. 2.

Referring now to the drawings, a preferred embodiment of the invention is illustrated in FIGS. 1-9. As shown in FIG. 1, sweeping machine 20 includes broom assembly 22. Broom assembly 22 includes lift assembly 24, core clamp and side shift assembly 26, and cover assembly 28 (not shown in FIGS. 3-9). As best shown in FIGS. 1 and 4, rear support 30 of lift assembly 24 is bolted onto or otherwise fixed to the front of vehicle 32 of sweeping machine 20. Because of the four-bar linkage construction of the preferred embodiment of the lift assembly, linear actuator 34, which is attached between rear support 30 and front support 36, may be actuated to raise and lower the front support 36 with respect to rear support 30 and vehicle 32.

Cover assembly 28 comprises stationary cover 38, left sliding cover 40 and right sliding cover 42. Covers 40 and 42 engage slide guides 44 (best shown in FIG. 2) for sliding engagement with stationary cover 38, enabling the left and right sliding covers to slide towards each other or away from each other as permitted by the sliding guides. Such movement allows the length of the cover assembly to be adjusted to cover brushes of various sizes that may be mounted on core clamp and side shift assembly 26. Cover assembly 28 also includes left side support 45 and right side support 46.

Figure 2:
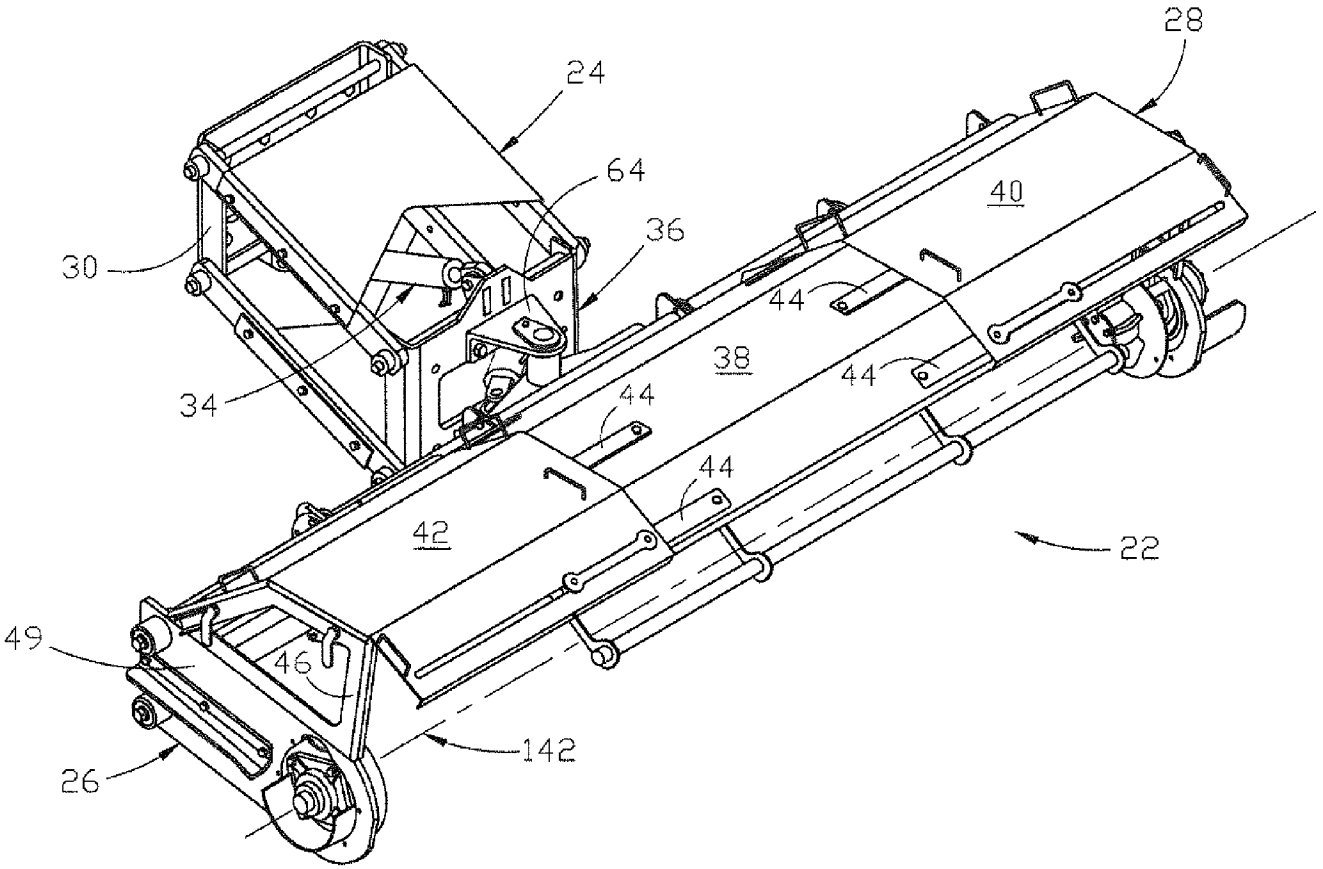
FIG. 2 is a perspective view of a broom assembly according to a preferred embodiment of the invention.
Figure 5:
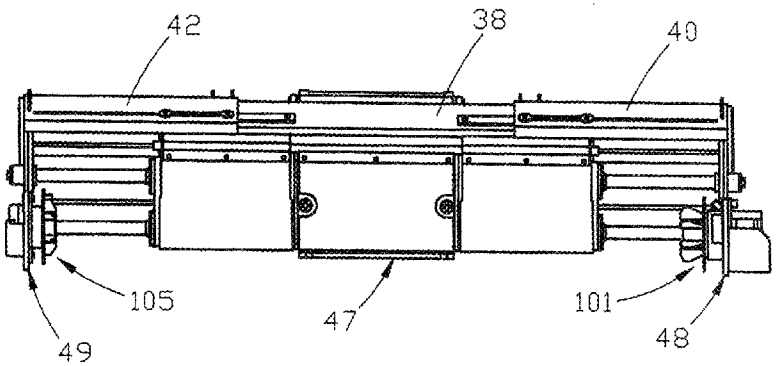
FIG. 5 is a front view of the broom assembly of FIGS. 2-4.

Core clamp and side shift assembly 26 includes center section 47, left side plate 48 and right side plate 49. As shown in FIG. 2, stationary cover 38 of cover assembly is fixed to center section 47, and right side support 46 is attached to right side plate 49. Similarly, FIG. 6 shows left side support 45 of cover assembly 28 attached to left side plate 48. Center section 47 also includes upper center tube 50 and lower center tube 52 (shown in FIG. 9), each of which is attached to bracket 54 and bracket 56. Also attached between brackets 54 and 56 are tube supports 58 and 60 which support pivot tube 62.

Bracket 64 is mounted on front support 36 of lift assembly 24 and to the top of pivot tube 62 of the core clamp and side shift assembly, and bracket 66 is mounted on front support 36 and to the bottom of pivot tube 62. Brackets 64 and 66 thus secure a pivot pin (not shown) that is retained within pivot tube 62, thereby allowing the core clamp and side shift assembly to pivot with respect to lift assembly 24 about generally vertical pivot axis 68 (shown in FIG. 6), as controlled by linear actuator 70, which is attached between lift assembly 24 (see FIG. 3) and bracket 72 of center section 47 of core clamp and side shift assembly 26.

Center section 47 of core clamp and side shift assembly 26 also includes left upper tube 74 and left lower tube 76, each of which is mounted between bracket 54 and bracket 78, and right upper tube 80 and right lower tube 82, each of which is mounted between bracket 56 and bracket 84 (best shown in FIG. 6). Left upper rod 86 and left lower rod 88 are attached to left slide plate 48 and are received in left upper tube 74 and left lower tube 76 respectively. A left side linear actuator includes left side cylinder 90, which is attached between bracket 54 and bracket 78, and associated left side rod 92, which passes through a slot in bracket 78. The distal end of rod 92 is attached to left slide plate 48.

Figure 9:
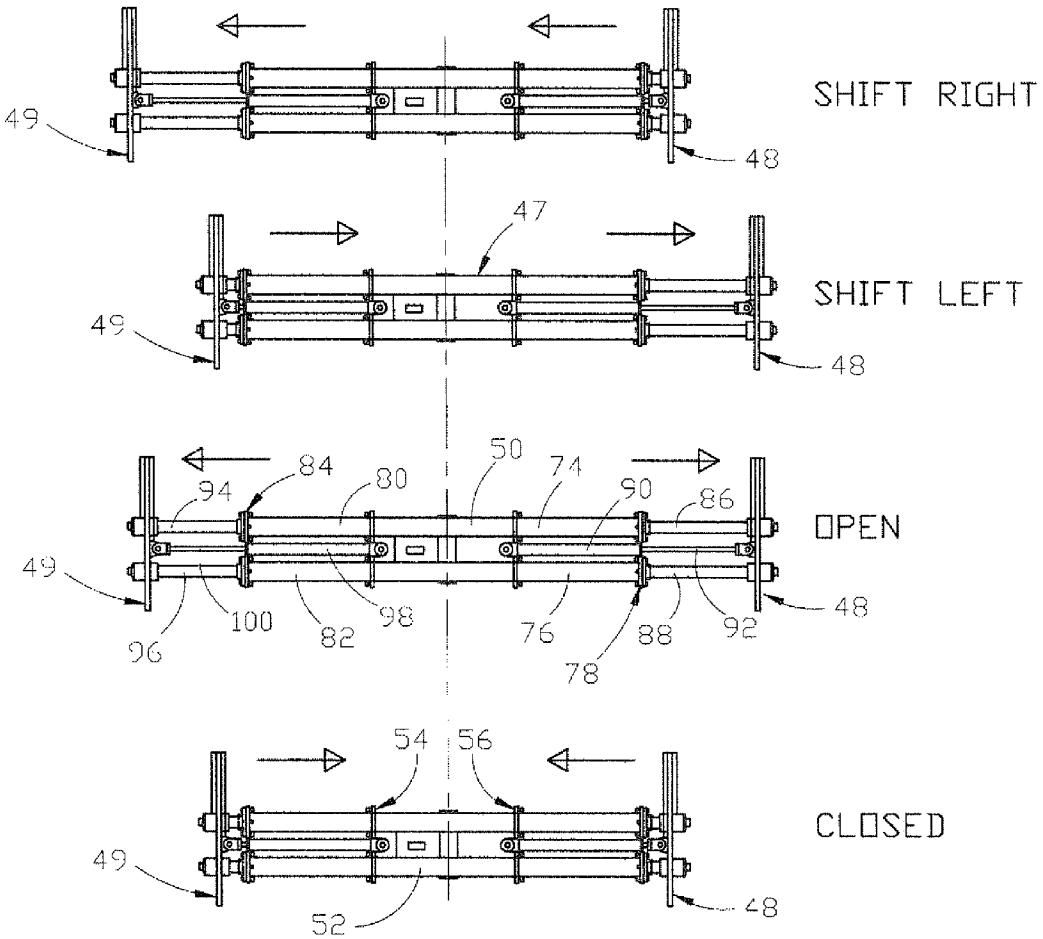
FIG. 9 is a front view of a portion of the broom assembly of a preferred embodiment of the invention, illustrating the various positions to which the broom assembly can be placed.

Referring now to FIG. 9, which shows several front views of a portion of the preferred broom assembly, the left side linear actuator may be actuated to move left side plate 48 from its outer or fully open position (illustrated in the OPEN and SHIFT LEFT views of FIG. 9) towards the center section, and from its inner or fully closed position (illustrated in the CLOSED and SHIFT RIGHT views of FIG. 9) towards its outer position. Since left sliding cover 40 is attached to left side support 45, which in turn is attached to left side plate 48, cover 40 will also move, as permitted by sliding guides 44, with respect to stationary cover 38 as the left side plate moves. Similarly, right upper rod 94 and right lower rod 96 are attached to right slide plate 49 and are received in right upper tube 80 and right lower tube 82 respectively. A right side linear actuator includes right side cylinder 98, which is attached between bracket 56 and bracket 84, and associated right side rod 100, which passes through a slot in bracket 84. The distal end of rod 100 is attached to right slide plate 49. Referring again to FIG. 9, the right side linear actuator may be actuated to move right slide plate 49 from its outer or fully open position (illustrated in the OPEN and SHIFT RIGHT views of FIG. 9) towards the center section, and from its inner or fully closed position (illustrated in the CLOSED and SHIFT LEFT views of FIG. 9) towards its outer position. Since right sliding cover 42 is attached to right side support 46, which in turn is attached to right side plate 49, cover 42 will also move, as permitted by sliding guides 44, with respect to stationary cover 38 as the right side plate moves.

Figure 10:
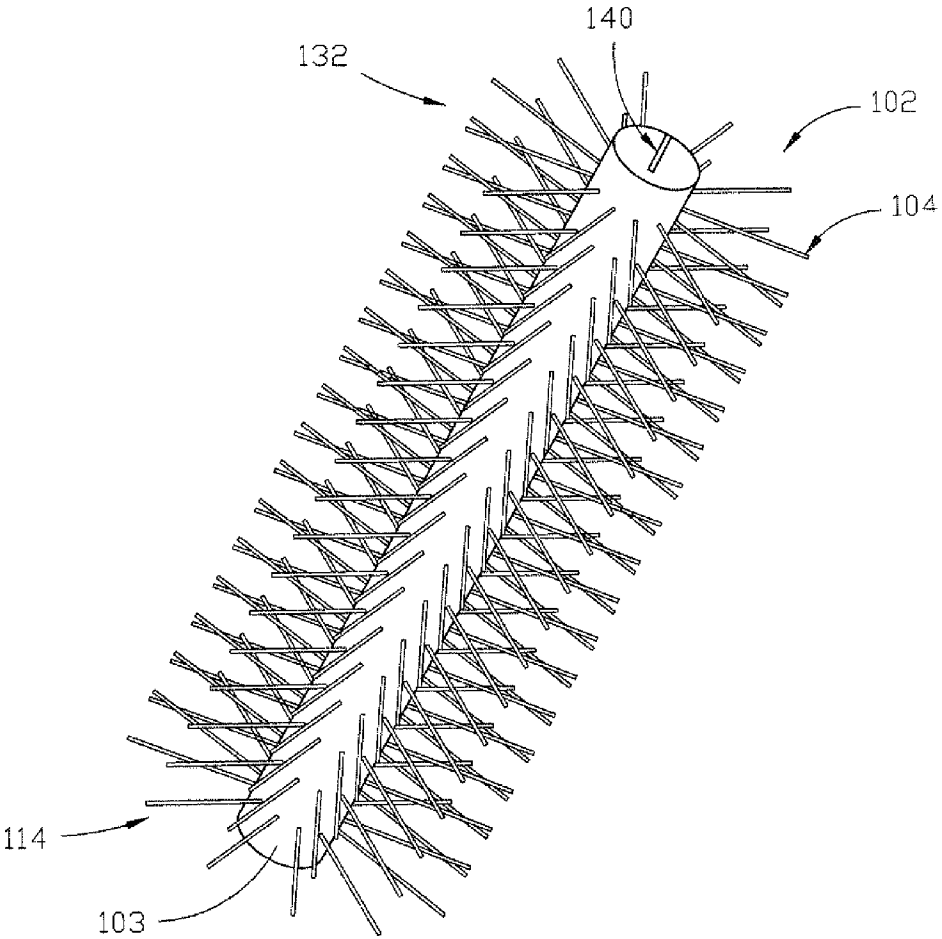
FIG. 10 is a perspective view of a brush that may be used in connection with the invention.

Drive assembly 101 of core clamp and side shift assembly 26 comprises a rotary actuator that is adapted to rotate brush 102, comprised of tubular core 103 to which a plurality of bristles 104 are attached as illustrated in FIG. 10, with respect to left side plate 48. Although drive assembly 101 is shown in the drawings as being attached to left side plate 48, it may alternatively be attached to the right side plate. Similarly, idle assembly 105 is adapted to rotate with the brush as with respect to right side plate 49, under the influence of drive assembly 101. Although idle assembly 105 is shown in the drawings as being attached to right side plate 49, it may alternatively be attached the left side plate if drive assembly 101 is attached to the right side plate.

As shown in FIG. 7, idle hub 106, a component of idle assembly 105, comprises central tube 108, back plate 110, front plate 111 and a plurality (six are preferred) of radially directed core support plates 112. The core support plates are preferably tapered to improve the alignment and fit of the idle hub to idle end 114 of tubular core 103 of brush 102. Front plate 111 of idle hub 106 includes a plurality of bolt holes 118 through which bolts 120 on attachment plate 122 of idle assembly 105 may be placed to secure the idle hub to the idle assembly.

As shown in FIG. 8, drive hub 124, a component of drive assembly 101, comprises central tube 126, back plate 128, front plate 129 and a plurality (six are preferred) of radially directed core support plates 130. The core support plates of the drive hub are preferably tapered on both their front (radially outer) and back (radially inner) sides. The front side taper aids in mounting of drive end 132 of tubular core 103 of brush 102 onto the drive hub, and compensates for a certain amount of misalignment. The back side taper assists in removal of core 103 from the drive assembly. Front plate 129 of drive hub 124 includes a plurality of bolt holes 134 through which bolts 136 on attachment plate 138 of drive assembly 101 may be placed to secure the drive hub to the drive assembly. A drive lug 140 is welded to the inside of drive end 132 of tubular core 103 of brush 102 and is engaged by one of the radial plates of the drive hub so that the brush may be rotated by the rotary actuator about core axis 142 (see FIGS. 1-3), which is defined by drive hub 124 on side plate 48 and idle hub 106 on side plate 49. The preferred construction of the drive hub and idle hub provide contact to the ends of the brush core sufficient to maintain the desired center of rotation, but limit the amount of contact to facilitate removal of the brush from the drive hub.

Broom assembly 22 of sweeping machine 20 is preferably operated using two separate control schemes, as controlled by controller 144 (shown schematically in FIG. 1). In the preferred work mode, core clamp and side shift assembly 26 and cover assembly 28 may be raised and lowered by linear actuator 34 through a range of motion that is less than that which linear actuator 34 is capable of achieving, as controlled by controller 144. Also in the preferred work mode, core clamp and side shift assembly 26 and cover assembly 28 may be pivoted to the left and right to the extent of the capability of linear actuator 70, as controlled by controller 144. In addition, in the preferred work mode, the left side linear actuator may be operated to shift the left side plate between the left open position (illustrated in the SHIFT LEFT and OPEN views of FIG. 9) and the left closed position (illustrated in the SHIFT RIGHT and CLOSED views of FIG. 9) along an axis that is parallel to core axis 142, and the right side linear actuator may be operated to shift the right side plate between the right open position (illustrated in the SHIFT RIGHT and OPEN views of FIG. 9) and the right closed position (illustrated in the SHIFT LEFT and CLOSED views of FIG. 9) along an axis that is parallel to core axis 142. More particularly, in the work mode of operation, the controller allows the left side linear actuator to shift the left side plate towards the left open position while the right side linear actuator shifts the right side plate towards the right closed position to the SHIFT LEFT position shown in FIG. 9. Similarly, the controller in the work mode of operation allows the right side linear actuator to shift the right side plate towards the right open position while the left side linear actuator shifts the left side plate towards the left closed position to the SHIFT RIGHT position shown in FIG. 9. This left and right shift, in the preferred work mode, is controlled by controller 144 so that the left and right side linear actuators will maintain positive pressure on tubular core 103, as determined by the length of the core, during any shifting to the left or the right.

In the preferred maintenance mode, the side shift control is disabled, so that the controller will only allow the left side linear actuator to shift the left side plate towards the left open position while the right side linear actuator shifts the right side plate towards the right open position. Similarly, when the side shift control is disabled, the controller will only allow the left side linear actuator to shift the left side plate towards the left closed position while the right side linear actuator shifts the right side plate towards the right closed position. This limitation on the operation of the left and right side linear actuators allows the core clamp and side shift assembly to be placed in either the open position shown in the OPEN view of FIG. 9 or the closed position shown in the CLOSED view of FIG. 9. When the core clamp and side shift assembly is in the open position shown in the OPEN view of FIG. 9, the brush can be easily removed from the assembly and replaced. Also in the maintenance mode of operation, the limits on the amount of elevation controlled by linear actuator 34 are disabled (so that linear actuator 34 may move through its entire range of motion).

Although this description contains many specifics, these should not be construed as limiting the scope of the invention, but as merely providing illustrations of the presently preferred embodiment thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A broom assembly for attachment to a vehicle, which assembly is adapted to rotate a brush having a tubular core, said broom assembly comprising:

(a) a center section;

(b) a pair of side plates, including a left side plate and a right side plate;

(c) a pair of hubs, including an idle hub on one of the side plates and a drive hub on the other of the side plates, said pair of hubs defining a core axis about which the brush is rotated;

(d) a first linear actuator that is adapted to move the left side plate with respect to the center section along an axis that is parallel to the core axis between a left open position and a left closed position;

(e) a second linear actuator that is adapted to move the right side plate with respect to the center section along an axis that is parallel to the core axis between a right open position and a right closed position.

2. The broom assembly of claim 1 wherein:

(a) the idle hub:

(i) includes an idle hub back plate;

(ii) includes an idle hub central tube that is attached to the idle hub back plate and is adapted to receive one end of the tubular core of the brush;

(iii) includes a plurality of idle hub core support plates that are attached to the idle hub back plate and spaced around the idle hub central tube and oriented radially with respect thereto, with each such idle hub core support plate having an inner radial edge adjacent to the idle hub central tube that is tapered outwardly from the idle hub back plate;

(iv) is adapted to rotate with respect to the side plate with which it is associated;

(b) the drive hub:

(i) includes a drive hub back plate;

(ii) includes a drive hub central tube that is attached to the drive hub back plate and is adapted to receive one end of the tubular core of the brush;

(iii) includes a plurality of drive hub core support plates that are attached to the drive hub back plate and spaced around the drive hub central tube and oriented radially with respect thereto, with each such drive hub core support plate having an inner radial edge adjacent to the drive hub central tube that is tapered outwardly from the drive hub back plate and an outer radial edge that is tapered outwardly from the drive hub back plate;

(iv) includes a rotary actuator that is adapted to rotate the drive hub with respect to the side plate with which it is associated.

3. The broom assembly of claim 1 which includes a cover assembly comprising:

(a) a stationary cover that is fixed to the center section;

(b) a left side support that is attached to the left side plate;

(c) a left sliding cover that is attached to the left side support and adapted to slide with respect to the stationary cover as the left side plate moves with respect to the center section;

(d) a right side support that is attached to the right side plate;

(e) a right sliding cover that is attached to right side support and adapted to slide with respect to the stationary cover as the right side plate moves with respect to the center section.

4. The broom assembly of claim 1 which comprises means for pivoting the center section about a generally vertical pivot axis.

5. The broom assembly of claim 1 which comprises:

(a) a lift assembly having a rear end and a front end, wherein the rear end is adapted to be attached to the vehicle, and the front end is attached to the center section;

(b) means for raising and lowering the center section with respect to the vehicle.

6. The broom assembly of claim 1:

(a) which includes a left upper rod that is generally parallel to the core axis and is attached to the left side plate;

(b) which includes a left lower rod that is generally parallel to the core axis and is attached to the left side plate;

(c) which includes a right upper rod that is generally parallel to the core axis and is attached to the right side plate;

(d) which includes a right lower rod that is generally parallel to the core axis and is attached to the right side plate;

(e) wherein the center section includes:

(i) a left upper tube that is generally parallel to the core axis and is adapted to receive the left upper rod in sliding engagement therewith;

(ii) a left lower tube that is generally parallel to the core axis and is adapted to receive the left lower rod in sliding engagement therewith;

(iii) a right upper tube that is generally parallel to the core axis and is adapted to receive the right upper rod in sliding engagement therewith;

(iv) a right lower tube that is generally parallel to the core axis and is adapted to receive the right lower rod in sliding engagement therewith.

7. The broom assembly of claim 1 which comprises:

(a) a lift assembly having a rear end and a front end, wherein the rear end is adapted to be attached to the vehicle, and the front end is attached to the center section;

(b) a third actuator that is adapted to raise and lower the center section with respect to the vehicle;

(c) a fourth actuator that is adapted to pivot the center section about a generally vertical pivot axis with respect to the lift assembly;

(d) a controller for controlling the operation of the first linear actuator, the second linear actuator, the third actuator and the fourth actuator, which controller is adapted to operate the broom assembly in a work mode:

(i) in which the controller allows the first linear actuator to shift the left side plate towards the left open position while the second linear actuator shifts the right side plate towards the right closed position;

(ii) in which the controller allows the second linear actuator to shift the right side plate towards the right open position while the first actuator shifts the left side plate towards the left closed position;

(iii) in which the controller allows the third actuator to raise and lower the center section with respect to the vehicle through a range of motion that is less than that which the third actuator is capable of achieving;

(iv) in which the controller allows the fourth actuator to pivot the center section about a generally vertical pivot axis to the extent of the capability of the fourth actuator.

8. The broom assembly of claim 7 wherein the controller is adapted to operate the broom assembly in a maintenance mode:

(a) in which the controller allows the first linear actuator to shift the left side plate towards the left open position only while the second linear actuator shifts the right side plate towards the right open position;

(b) in which the controller allows the first linear actuator to shift the left side plate towards the left closed position only while the second linear actuator shifts the right side plate towards the right closed position;

(c) in which the controller allows the third actuator to raise and lower the center section with respect to the vehicle through the entire range of motion that the third actuator is capable of achieving.

9. A broom assembly for attachment to a vehicle, which assembly is adapted to rotate a brush having a tubular core, said broom assembly comprising:

(a) a pair of side plates, including a left side plate and a right side plate;

(b) a pair of hubs, including an idle hub on one of the side plates and a drive hub on the other of the side plates, said pair of hubs defining a core axis about which the brush is rotated;

(c) a left rod that is generally parallel to the core axis and is attached to the left side plate;

(d) a right rod that is generally parallel to the core axis and is attached to the right side plate;

(e) a center section comprising:

(i) a left tube that is generally parallel to the core axis and is adapted to receive the left rod in sliding engagement therewith;

(ii) a left side linear actuator that is adapted to apply a linear force between the center section and the left side plate to move the left side plate with respect to the center section along an axis that is parallel to the core axis;

(iii) a right tube that is generally parallel to the core axis and is adapted to receive the right rod in sliding engagement therewith;

(iv) a right side linear actuator that is adapted to apply a linear force between the center section and the right side plate to move the right side plate with respect to the center section along an axis that is parallel to the core axis.

10. The broom assembly of claim 9 wherein:

(a) the idle hub:

(i) includes an idle hub back plate;

(ii) includes an idle hub central tube that is attached to the idle hub back plate and is adapted to receive one end of the tubular core of the brush;

(iii) includes a plurality of idle hub core support plates that are attached to the idle hub back plate and spaced around the idle hub central tube and oriented radially with respect thereto, with each such idle hub core support plate having an inner radial edge adjacent to the idle hub central tube that is tapered outwardly from the idle hub back plate;

(iv) is adapted to rotate with respect to the side plate with which it is associated;

(b) the drive hub:

(i) includes a drive hub back plate;

(ii) includes a drive hub central tube that is attached to the drive hub back plate and is adapted to receive one end of the tubular core of the brush;

(iii) includes a plurality of drive hub core support plates that are attached to the drive hub back plate and spaced around the drive hub central tube and oriented radially with respect thereto, with each such drive hub core support plate having an inner radial edge adjacent to the drive hub central tube that is tapered outwardly from the drive hub back plate and an outer radial edge that is tapered outwardly from the drive hub back plate;

(iv) includes a rotary actuator that is adapted to rotate the drive hub with respect to the side plate with which it is associated.

11. The broom assembly of claim 9 which includes a cover assembly comprising:

(a) a stationary cover that is fixed to the center section;

(b) a left side support that is attached to the left side plate;

(c) a left sliding cover that is attached to the left side support and adapted to slide with respect to the stationary cover as the left side plate moves with respect to the center section;

(d) a right side support that is attached to the right side plate;

(e) a right sliding cover that is attached to right side support and adapted to slide with respect to the stationary cover as the right side plate moves with respect to the center section.

12. The broom assembly of claim 9 which includes an actuator that is adapted to pivot the center section about a generally vertical pivot axis.

13. The broom assembly of claim 9 which comprises:

(a) a lift assembly having a rear end and a front end, wherein the rear end is adapted to be attached to the vehicle, and the front end is attached to the center section;

(b) an actuator that is adapted to raise and lower the center section with respect to the vehicle.

* * * * *